US010040654B2

(12) United States Patent
Ross, Jr. et al.

(10) Patent No.: US 10,040,654 B2
(45) Date of Patent: Aug. 7, 2018

(54) ENVELOPE PRINTING SYSTEM

(71) Applicant: Xante Corporation, Mobile, AL (US)

(72) Inventors: Robert C. Ross, Jr., Fairhope, AL (US); Kenneth Orin Parker, Theodore, AL (US); Joseph Martin deVeer, Mobile, AL (US)

(73) Assignee: Xante Corporation, Mobile, AL (US)

( * ) Notice: Subject to any disclaimer, the term of this patent is extended or adjusted under 35 U.S.C. 154(b) by 0 days.

(21) Appl. No.: 15/382,649

(22) Filed: Dec. 17, 2016

(65) Prior Publication Data

US 2018/0170696 A1 Jun. 21, 2018

(51) Int. Cl.

| | |
|---|---|
| ***B65H 5/02*** | (2006.01) |
| ***B65H 31/02*** | (2006.01) |
| ***B65H 43/06*** | (2006.01) |

(52) U.S. Cl.

CPC ..... *B65H 5/021* (2013.01); *B65H 31/02* (2013.01); *B65H 43/06* (2013.01); *B65H 2553/00* (2013.01); *B65H 2701/1916* (2013.01)

(58) Field of Classification Search

CPC . B65H 7/02; B65H 1/02; B65H 1/025; B65H 1/08; B65H 1/22; B65H 7/00; B65H 7/14; B65H 2701/1916; B65G 47/22; B65G 47/24; B65G 47/244; B65G 47/26; B65G 47/28; B65G 47/29; B65G 47/30; B65G 47/31; B65G 59/00; B65G 59/12

USPC ... 271/2, 149, 150, 151, 152, 154, 155, 157; 198/418.7, 418.9, 459.1, 460.3

See application file for complete search history.

(56) References Cited

U.S. PATENT DOCUMENTS

| | | | |
|---|---|---|---|
| 4,522,382 | A | 6/1985 | Miller |
| 5,356,129 | A | 10/1994 | Godlewski |
| 8,181,768 | B2 | 5/2012 | Kalm |
| 8,939,274 | B1 | 1/2015 | Ross, Jr. et al. |

*Primary Examiner* — David H Bollinger

(74) *Attorney, Agent, or Firm* — The Gache Law Firm, P.C.; Russell C. Gache

(57) ABSTRACT

The system is the combination of an envelope feeder and a laser printer, with some additional control mechanisms. An envelope conveyor system is positioned adjacent to a media input slot on a laser printer and envelopes are fed into a pickup assembly positioned within the media input slot in a controlled manner. By controlling the conveyor speed, a stack of envelopes having a limited and known number of envelopes is accumulated within the pickup assembly such that the pickup roller in the assembly can feed envelopes into the printer at a rate equal to or greater than the speed at which the printer can apply an image to each envelope. A control circuit provides a feedback signal to the conveyor to control conveyor motor actuation. The result is a smaller, less expensive and simpler feed system for an envelope printer.

19 Claims, 5 Drawing Sheets

ENVELOPE PRINTING SYSTEM

FIELD OF THE INVENTION

The present invention relates generally to sheet feeder mechanisms for electrographic printing machines. In greater particularity, the present invention relates to the use of a conveyor to feed envelopes into a printing machine. In even greater particularity, the present invention relates to conveyor based envelope feeders for laser or inkjet printers.

BACKGROUND OF THE INVENTION

Envelope printing systems even with customized feeders are typically limited by the speed of the media pickup assembly used to feed the envelopes into a laser printer. These pickup assemblies typically include a pickup roller that feeds a single envelope into the printer as the printer is ready to print each page image present on the transfer roller of the printer. Even if a customized feeder is utilized that delivers a single envelope quickly from an "endless" stack of envelopes adjacent to the pickup roller when the feeder senses that the media input tray below the pickup roller is empty, a lag is present in moving the envelope from the feeder into the media slot housing the pickup assembly.

For example, U.S. Pat. No. 8,939,274 B1 issued to Robert C. Ross, Jr. discloses a printer feeding system in which a dual conveyor system advances envelopes from a vertical position to a horizontal position in a timed manner so that a receiving printer may ingest and process envelopes at a continual and reliable speed. That patent also discloses sensor inputs and control circuits to control the advancement of envelopes on a conveyor by controlling a drive motor in the feeder. However, the Ross system while practical and economical in a mass production environment is still larger and less economical in light envelope production environments.

Hence, what is needed is an envelope feeder system that feeds envelopes into a laser printer assembly at high speed with minimal area and at a reduced cost.

SUMMARY OF THE INVENTION

The invention is the combination of an envelope feeder and a laser printer, with some additional control mechanisms. A conveyor is positioned adjacent to the media input slot on a commercial laser printer and envelopes are feed into the pickup assembly of the media input slot in a controlled manner. By controlling the conveyor speed, a limited stack of envelopes is accumulated within the pickup assembly such that the pickup roller in the assembly can feed envelopes into the printer at a rate equal to or greater than the speed at which the printer can apply an image to each envelope. A control circuit provides a feedback signal to the conveyor to control conveyor motor actuation.

Other features and objects and advantages of the present invention will become apparent from a reading of the following description as well as a study of the appended drawings.

BRIEF DESCRIPTION OF THE DRAWINGS

A high speed envelope printing system incorporating the features of the invention is depicted in the attached drawings which form a portion of the disclosure and wherein.

DESCRIPTION OF THE PREFERRED EMBODIMENTS

Figure 1:
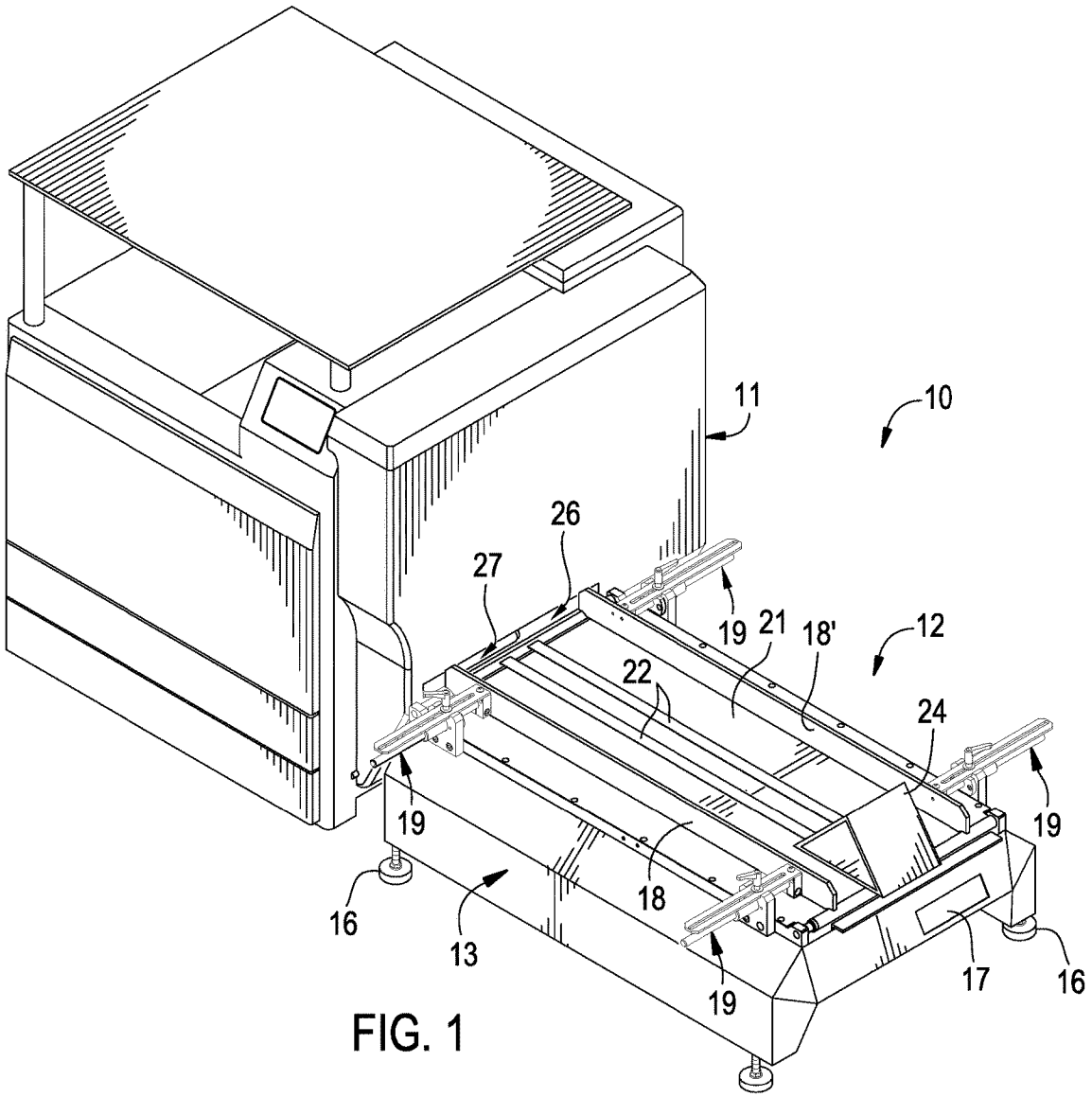
FIG. 1 a perspective view of a high speed envelope printing system.

Referring to the drawings for a better understanding of the function and structure of the invention, FIG. 1 shows a high speed envelope printer 10 having a laser printer 11 positioned adjacent to an envelope feeder 12. Printer 11 includes a media input slot 26 and feeder 12 is positioned such that its output is directly adjacent to the input slot 26 as shown. Feeder 12 includes an integrated cased and frame 13, height adjusting legs 16, and a control panel 17. The case 13 supports twin media guide vanes 18,18' that include adjustment knobs 19 for movement of the guide vanes 18,18' in and out relative to the travel path of envelopes on the feeder to accommodate different sizes of envelopes. The feeder 12 includes a media bed 21 that supports a number of conveyor belts 22 having a surface configured to adhere to and move a series of envelopes toward the printer 11 as the belts move forward. A media backstop 24 orients envelopes placed in a series against it.

Figure 2:
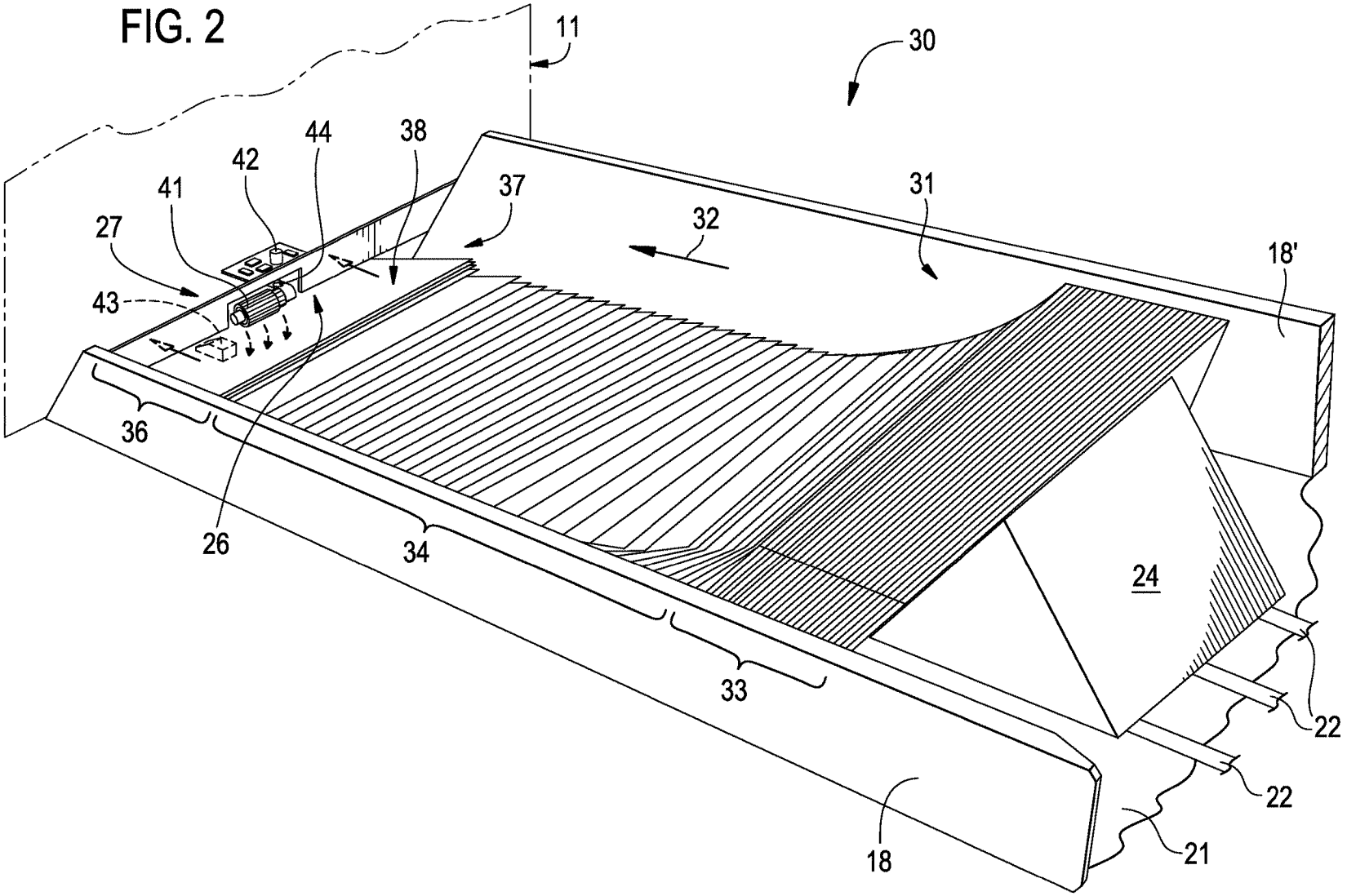
FIG. 2 is a perspective view of an envelope feeder connected to a media feed slot on a laser printer.

Referring to FIG. 2, a feeding process 30 is shown. A series of envelopes 31 is positioned in substantially vertical orientation grouped 33 against backstop 24. Conveyor belts 22 move envelopes 31 toward media slot 26 creating an configured orientation for envelopes 31 as they move forward pursuant to downstream direction 32. As the envelopes 31 move downstream 32 responsive to belt 22 movement, group 33 transitions into a shingled group 34 of envelopes until reaching an area below pickup roller 41. Below pickup roller 41 envelopes 31 congregate into a stack 37 that forms horizontal stack group 36 partially positioned within media input slot 26. The stack 37 includes a top envelope 38 and bottom envelope 39 (not shown-see FIG. 3). Proximity sensor assembly 42 and position sensor 43 work in conjunction with other electronics to control the stack 37 height.

Figure 3:
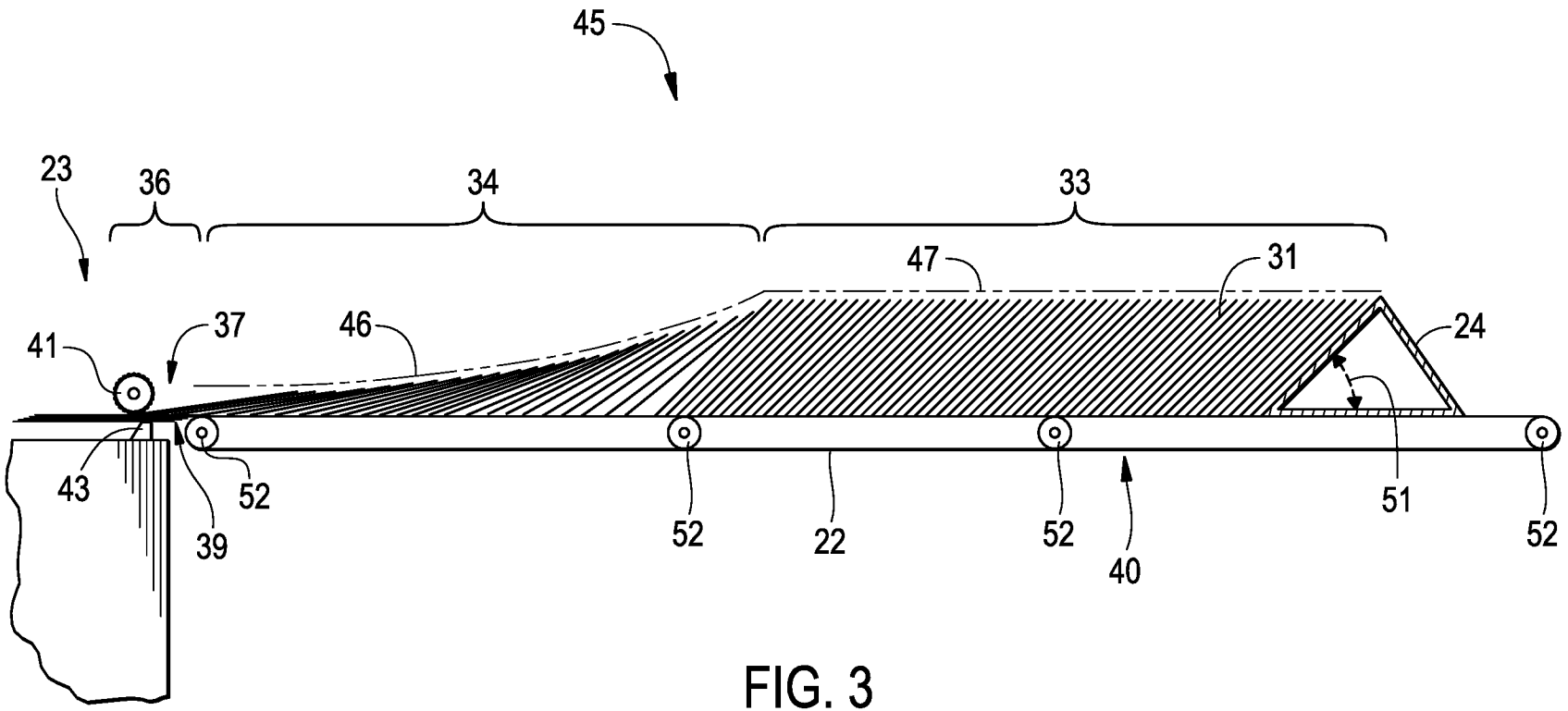
FIG. 3 is a side elevational view of the envelope feeder and certain elements of the laser printer media feed slot.

Referring to FIG. 3, movement of belts 22 are controlled by a series of rollers 52, one of which is rotated by a drive motor (not shown) supported by feeder 12 to form belt assembly 40. As belts 22 are advanced in direction 32, movement of envelopes 31 creates an upper surface shape in groups 33 and 34. Group 33 has a liner shape and group 34 has a sloped curve shape 46. As envelope group advances forward the singled envelopes move under pickup roller 41 with the envelope closest to the printer 11 having direct contact with roller 41, thereby becoming a top envelope 38 in a stack of envelopes 37. Envelopes trailing envelope 38 are forced forward under envelope 38 as they advance to enlarge the stack 37. The group of stacked envelopes 36 is preferably maintained at a stack height of 4-8 envelopes, as will be explained. As can be understood, the stack 36 orients the envelopes horizontally relative to the conveyor bed 21 and includes an upper most or top envelope 38 and a bottom envelope 39 at any instant in time after stack group 36 is formed within media slot 26.

In order to control the number of envelopes present in stack group 36, the present invention regulates the movement of the conveyor belts 22 via motor control. A viable electrical control system to control the advancement of a conveyor system is disclosed in FIG. 9 of U.S. Pat. No.

Figure 4:
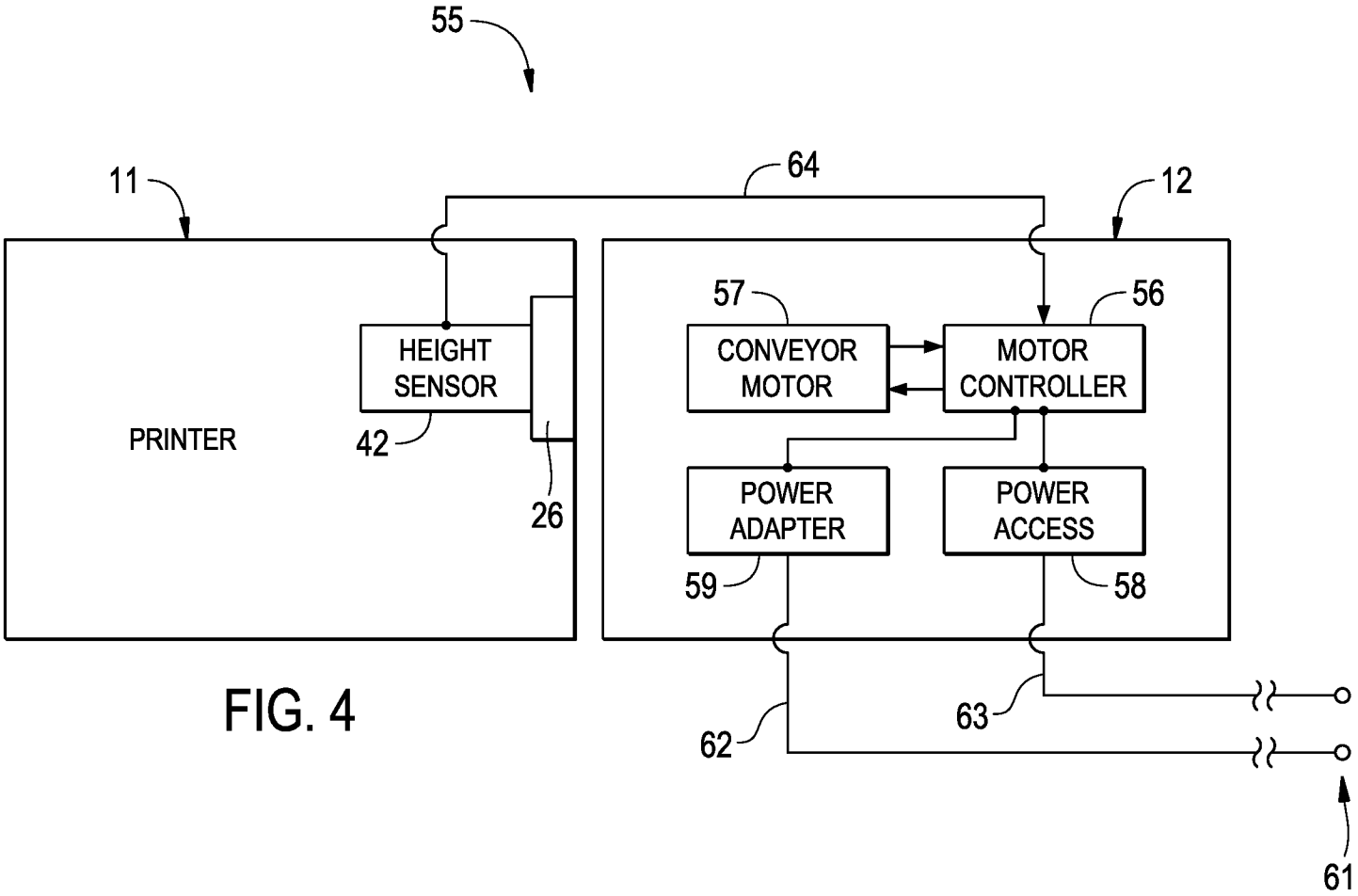
FIG. 4 is a control diagram for the pick roller in the laser printer.

8,939,274 B1 to Ross (also mentioned above) as described at Col. 7, line 42 through Col. 8, line 25, and that disclosure is hereby incorporated by reference. However, the Ross control system is altered to establish and maintain a predetermined quantity of envelopes, typically 4-8 envelopes is preferred, via supplemental control elements 55 shown in present FIG. 4. Printer 11 includes height sensor assembly 42 positioned within media slot 26 and having a cooperatively positioned reflector 44 on pickup roller 41 (see FIG. 2). As envelope stack group 36 increases in height, assembly 42 reads a distance measure that corresponds to a height distance known to include a certain number of envelopes having a predetermined paper weight. Height sensor 42 is electrically connected to envelope feeder 12 via electrical connection 64, and in particular to a controller 56 held by control circuitry in feeder 12. Conveyor motor 57 is controlled by controller 56 responsive to height sensor readings by controller via electrical channel 64. Power adaptor 59 and power access assembly 58 provide power to motor 57 and controller 56 via electrical connections 62,63 connected to utility power source outlet 61.

Figure 5:
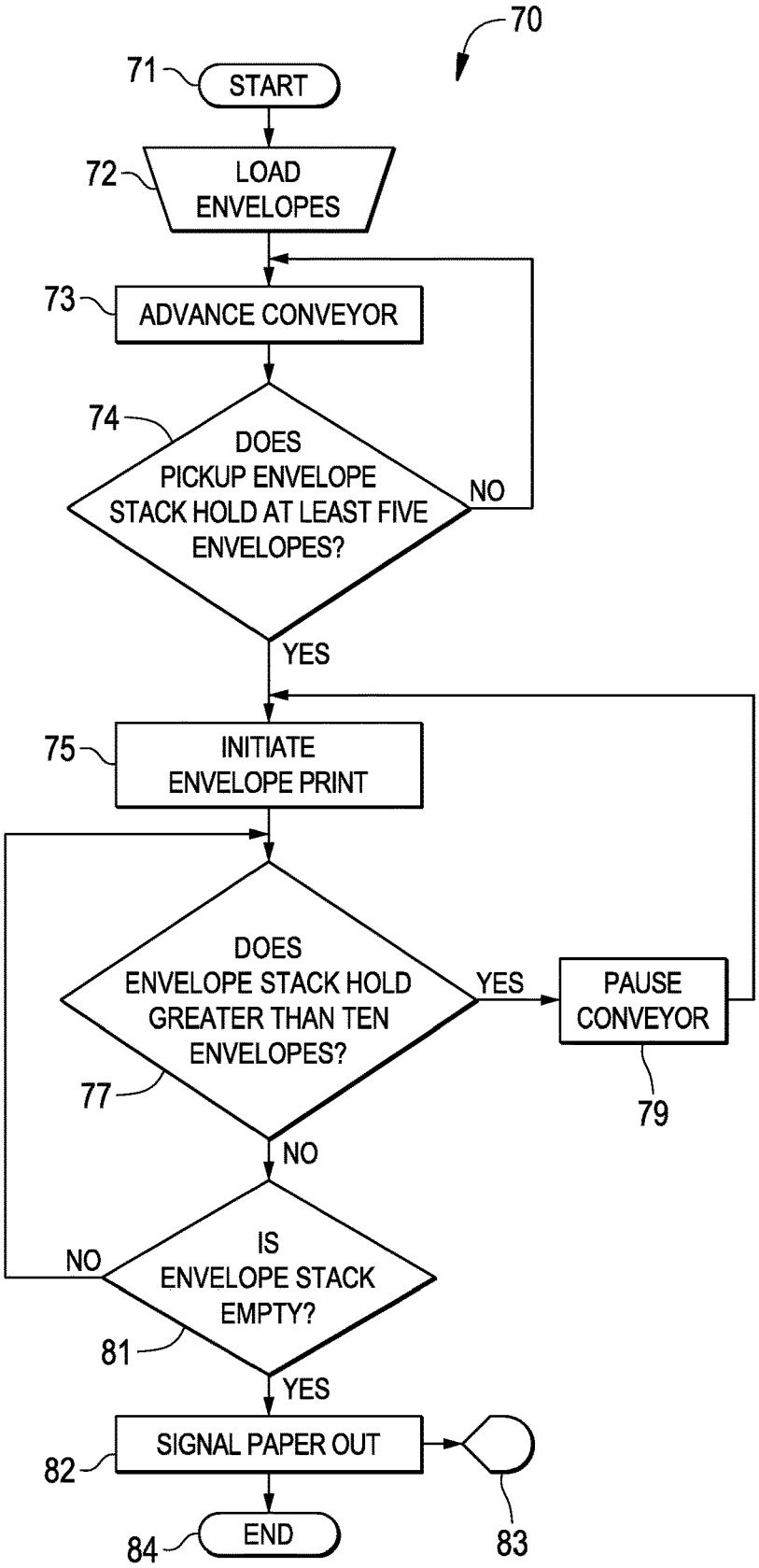
FIG. 5 is a flow diagram of the media feeding system.

Referring to FIG. 5, an example of a stack 36 configured to hold 5-10 envelopes is shown in operation of the system 10. The example stack quantity is an example only and as will be understood quantities that vary between 2 and 20 envelopes will work in the disclosed system 10. As shown the feeder 12 receives a series of envelopes that are typically loaded by hand 72 against backstop 24 in substantially vertically position supported by conveyor bed 21 and then advanced initially by hand to create a sloped but substantially horizontally oriented column of envelopes. Once loaded, the backstop 24 may then be removed. When initiated, conveyor belts 22 are actuated 73 to advance the column of envelopes toward media input slot 26. The envelopes are advanced as described above until envelope group 36 contains at least 2 envelopes as provided by sensor assembly 42. As long as the group 36 includes at least 2 envelopes the system 74 initiates printing of envelopes 75, alternatively the system waits until the feeder conveyors deposit the necessary 2 envelopes into the stack. The feeder 12 continues to deposit envelopes into the stack group 36 until a maximum of 10 envelopes 77 is reached. An optimum group of between 5 and 8 envelopes using 10 lbs. weight paper is preferred, but the inventors anticipate height readings will vary and that the system 10 would need to be calibrated to maintain such an envelope stack quantity in response to various types of paper weight utilized. For the purposes of this embodiment, while a minimum of 2 envelopes in the stack is satisfactory, an example minimum of 5 envelopes is shown in FIG. 5 at step 74.

If 10 envelopes are reached in stack 36, feeder conveyors are paused 79 until printer 10 can dispose of 2-3 envelopes in the stack. As may be understood, feeder 12 must at all times be capable of supplying envelopes into stack 36 equal to or greater than the speed at which printer 11 will print envelopes. The system 10 also determines whether the envelope stack is empty 81 via optical position sensor 43 (see FIG. 2), and issues a paper out signal 82 and indicator 83 to end the printing sequence 84. As may be seen, printer 11 shall continue printing as long as envelopes are present in stack 36.

While I have shown my invention in one form, it will be obvious to those skilled in the art that it is not so limited but is susceptible of various changes and modifications without departing from the spirit thereof.

Having set forth the nature of the invention, what is claimed is:

1. A system for printing envelopes, comprising:

a. a printer, said printer including a pickup assembly and a media input slot on one side, wherein said pickup assembly is positioned within said media input slot;

b. an envelope feeder positioned adjacent to said printer, said feeder including only one conveyor for supporting and moving envelopes in a downstream direction, and wherein said feeder includes a downstream end positioned adjacent to said input slot such that envelopes moving downstream are forced to aggregate into a horizontal stack of envelopes at said pickup assembly;

c. a sensor positioned at said pickup assembly for determining the number of envelopes held in said aggregated stack of envelopes at said pickup assembly;

d. said printing system including a communications link from said printer to said feeder for controlling the movement of said envelopes in said feeder; and, e. wherein said sensor and communications link cause said feeder conveyor to force said envelopes downstream into an aggregated envelope stack at said pickup assembly, wherein said system is adapted to maintain a pre-selected number of envelopes at said aggregated stack and said printer conveys envelopes from said stack into a printing area within said printer.

2. An envelope printing system as recited in claim 1, wherein said feeder is further configured to transition envelopes loaded on said conveyor from a substantially vertical position to a substantially horizontal position in a shingled movement form as said envelopes move in a downstream direction.

3. An envelope printing system as recited in claim 2, further including a control circuit in said feeder connected to said pickup assembly sensor via said communications link for controlling said feeder, and wherein said feeder includes a driving motor connected to said at least one conveyor belt for moving said same and wherein said control circuit varies movement of said motor.

4. An envelope printing system as recited in claim 3, wherein said pickup sensor comprises a sensor assembly having a reading sensor positioned adjacent to said pickup assembly roller configured to register the height of said pickup stack and communicate said height through said communications link to said feeder control circuit.

5. An envelope printing system as recited in claim 4, further including a sensor for determining when said aggregated envelope stack at said pickup assembly is empty and sending a signal to said feeder upon such empty condition.

6. A envelope printing system as recited in claim 5, wherein said feeder includes an envelope backstop for orienting said envelopes in a substantially vertical position on said feeder at an end distal said downstream end.

7. An envelope printing system as recited in claim 1, wherein said pickup sensor comprises a sensor assembly having an reading sensor positioned adjacent to said pickup assembly roller configured to register the height of said pickup stack and communicate said height through said communications link to said feeder control circuit.

8. An envelope printing system as recited in claim 7, wherein said feeder is loaded with envelopes on said conveyor in a shingled orientation from a substantially vertical position to a substantially horizontal position in a downstream direction.

9. An envelope printing system as recited in claim 1, further including a control circuit in said feeder connected to said pickup assembly sensor via said communications link for controlling said feeder, and wherein said feeder includes a driving motor connected to said at least one conveyor belt for moving said same and wherein said control circuit varies movement of said motor.

10. An envelope printing system as recited in claim 9, further including a sensor for determining when said aggregated envelope stack at said pickup assembly is empty and sending a signal to said feeder upon such empty condition.

11. A system for printing envelopes, comprising:

a. a printer, said printer including a media input slot on one side of said printer and means positioned within said input slot for picking up and delivering said envelopes from said input slot to a printing area within said printer;

b. an envelope feeder positioned adjacent to said printer, said feeder including only one means for conveying envelopes in a downstream direction, and wherein said feeder further includes a downstream end positioned adjacent to said input slot such that envelopes moving downstream are forced by said conveying means to aggregate into a horizontal stack of envelopes at said pickup assembly means;

c. sensor means positioned at said pickup assembly for determining the number of envelopes held in said aggregated stack of envelopes at said pickup assembly means;

d. said printing system including communication means from said printer to said feeder for controlling the movement of said envelopes in said feeder; and, e. wherein said sensor means and communication means cause said conveyor means to force said envelopes downstream at a rate such that said aggregated envelope stack at said pickup assembly means is maintained at a pre-selected number of envelopes as said printer conveys envelopes from said pickup assembly means to said printing area within said printer.

12. An envelope printing system as recited in claim 11, wherein said feeder is loaded with envelopes on said conveyor in a shingled orientation from a substantially vertical position to a substantially horizontal position in a downstream direction.

13. An envelope printing system as recited in claim 12, further including means for electrically controlling said feeder and connected to said pickup assembly sensor means via said communications means for controlling said feeder, and wherein said feeder includes a driving means connected to said at least one conveyor belt for moving said same and wherein said control means varies movement of said driving means.

14. An envelope printing system as recited in claim 3, wherein said pickup sensor means comprises a sensor assembly having an reading sensor positioned adjacent to said pickup assembly roller configured to register the height of said pickup stack and communicate said height through said communications means to said feeder control means.

15. An envelope printing system as recited in claim 11, further including means for determining when said aggregated envelope stack at said pickup assembly is empty and sending a signal to said feeder upon such empty condition.

16. A envelope printing system as recited in claim 15, wherein said feeder includes an envelope backstop for initially orienting said envelopes in a substantially vertical position on said feeder at an end distal said downstream end.

17. A method for printing envelopes using a printer and an adjacently positioned envelope feeder having a single conveyor, comprising the steps of:

a. loading envelopes on said envelope feeder;

b. advancing only a single conveyor within said envelope feeder supporting said envelopes in a downstream direction until a horizontally oriented stack of envelopes is forced to be aggregated in a pickup assembly positioned in said printer to a predetermined number of envelopes;

c. initiating printing in said printer such that envelopes are removed from said aggregated stack;

d. after said printing initiating step, monitoring the height of said stack with sensors in said printer and advancing said single conveyor through a communications link such that said single conveyor movement forces additional envelopes in a downstream direction to replenish said aggregated stack at a rate that maintains a predetermined range of envelopes in said aggregated stack; and, e. monitoring said aggregated stack of envelopes with a sensor in said printer and sending a signal to a control circuit upon depletion of said stack to zero number of envelopes.

18. A method of printing envelopes as recited in claim 17, wherein said feeder is loaded with envelopes on said conveyor in a shingled orientation from a substantially vertical position to a substantially horizontal position in a downstream direction.

19. A method of printing envelopes as recited in claim 18, further comprising the step of responsively using a sensor to monitor the number of envelopes present in said aggregated stack of envelopes and sending a signal through said communications link to a control circuit in said feeder, wherein said control circuit controls movement of said conveyor.

* * * * *